United States Patent [19]

Pfander

[11] Patent Number: 4,642,915

[45] Date of Patent: Feb. 17, 1987

[54] ARTICLE OF FOOTWEAR AND METHOD OF MAKING SAME

[75] Inventor: Wilhelm Pfander, Brewer, Me.

[73] Assignee: Penobscot Shoe Company, Old Town, Me.

[21] Appl. No.: 765,400

[22] Filed: Aug. 14, 1985

[51] Int. Cl.[4] ..... A43B 9/00

[52] U.S. Cl. ..... 36/57; 36/47; 36/18; 12/142 D

[58] Field of Search ..... 36/57, 47, 45, 18, 19 R; 12/142 D, 142 C, 142 MC

[56] References Cited

U.S. PATENT DOCUMENTS

| | | | |
|---|---|---|---|
| 14,617 | 3/1919 | Cavanagh | 12/142 D |
| 391,025 | 10/1888 | Coombs | 36/57 |
| 1,922,051 | 8/1933 | Lapidus | 36/45 |
| 2,535,560 | 12/1950 | Barr | 36/45 |
| 2,984,918 | 5/1961 | Glassman | 36/46.5 |
| 3,135,060 | 6/1964 | McConnell | 36/57 |
| 3,259,931 | 7/1966 | Levenson | 36/142 MC |
| 4,023,283 | 5/1977 | Pfander | 36/142 MC |
| 4,034,431 | 7/1977 | Fukuoka | 12/142 MC |

FOREIGN PATENT DOCUMENTS

| | | | |
|---|---|---|---|
| 189230 | 9/1907 | Fed. Rep. of Germany | 36/46.5 |
| 2024601 | 1/1980 | United Kingdom | 36/19 R |

OTHER PUBLICATIONS

Miller, Manual of Shoemaking, 1980, pp. 2, 16, 17.

*Primary Examiner*—Werner H. Schroeder
*Assistant Examiner*—Mary A. Ellis
*Attorney, Agent, or Firm*—Quaintance, Murphy & Presta

[57] ABSTRACT

An article of footwear comprising a flexible top portion of the upper, and a flexible under portion of the upper. The top portion and under portion are joined at their overlapped perimeters by handsewing or by machine stitching to form a forepart of the article of footwear and to form a seam therebetween. The seam is located closely adjacent and substantially parallel to the edge of a sole portion joined to the under portion of the forepart. In the case of handsewing, the perimeters of the top portion and the under portion are provided with apertures therethrough.

12 Claims, 5 Drawing Figures

Fig. 1
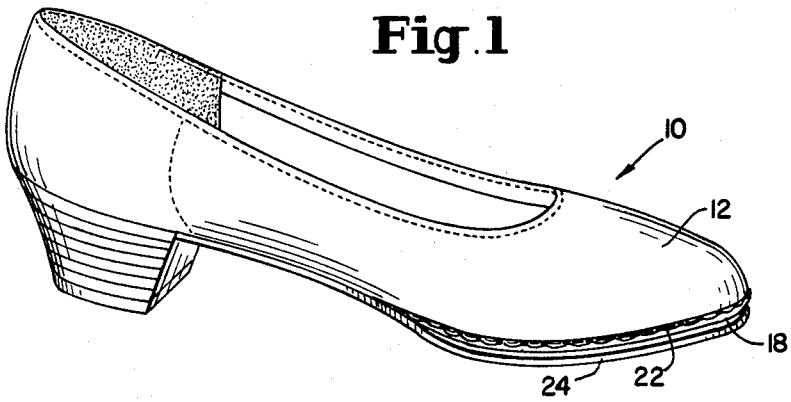
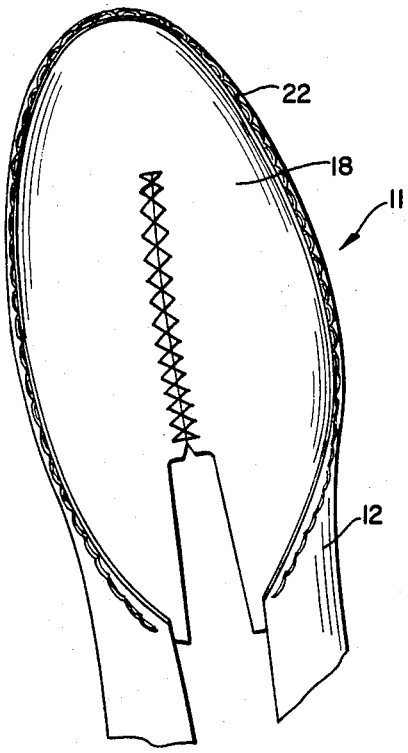
Fig. 2
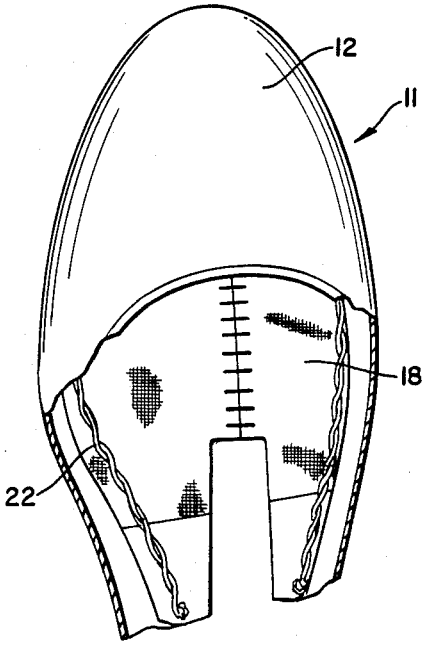
Fig. 3

ARTICLE OF FOOTWEAR AND METHOD OF MAKING SAME

BACKGROUND OF THE INVENTION

The present invention relates to a shoe construction and method of making same, and more particularly, to a pump or any other non-moccasin type of footwear which can be fashioned without the use of a conventional innersole or a conventional toe piece in the forepart of the shoe. The new and improved construction and method of the present invention enable the features and comfort associated with a genuine moccasin construction to be incorporated into a full range of footwear styles.

Shoes such as pumps and other non-moccasin types of footwear are presently constructed using a conventional innersole or a conventional toe piece in the forepart of the shoe. While this conventional construction has generally served the purpose of producing a wearable shoe, it has not previously been possible to produce a non-moccasin type of shoe with the features and comfort of a handsewn moccasin.

SUMMARY OF THE INVENTION

The shoe constructed in accordance with the present invention is a pump or any other non-moccasin type of footwear. The forepart of the upper of the shoe is formed by handsewing or conventionally stitching the perimeter of the top portion of the upper to the perimeter of the under portion, or foot cradle portion, of the upper so that the resultant seam will be located just above the "feather-line" of the sole when the sole is attached to the upper.

Prior to the handsewing or stitching of the top portion to the under portion of the upper, reinforcing materials with conforming properties are combined with the critical areas. After the portions are joined, conventional shaping equipment is used to set the upper into the desired shape for easy introduction of, and conformance to, the forepart of the last. Conventional slip-lasting and finishing procedures are employed to complete the shoe.

The present invention permits the production of stylish, attractive and comfortable, non-moccasin types of footwear possessing the softness, flexibility and comfort characteristics of the traditional moccasin construction. The construction and process of the present invention avoid the conventional U-shaped seam as located on the vamp of a traditional moccasin.

DESCRIPTION OF THE DRAWINGS

FIG. 1 is a perspective view of a shoe pump constructed in accordance with the principles of the present invention.

FIG. 2 is a bottom view of the forepart of the shoe shown in FIG. 1 during one stage of the manufacture thereof;

FIG. 3 is a top view of the forepart of the shoe shown in FIG. 2, with a portion cut away to reveal the seam;

DESCRIPTION OF THE PREFERRED EMBODIMENTS

FIG. 1 illustrates a shoe such as a closed pump 10 which is constructed in accordance with the principles of the present invention. The shoe 10 comprises a top portion 12 of the upper and an under portion 18 of the upper, formed of any suitable flexible materials such as leather.

Figure 4:
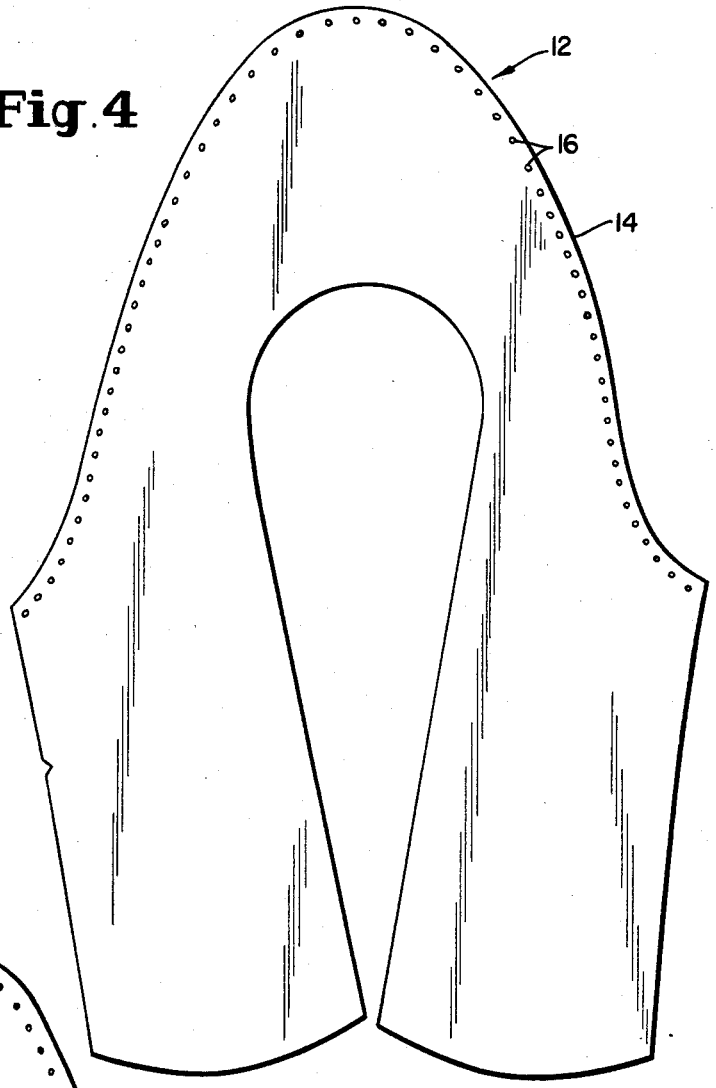
FIG. 4 is a top view of the top portion of the upper of the shoe prior to formation of the upper forepart shown in FIGS. 2 and 3.
Figure 5:
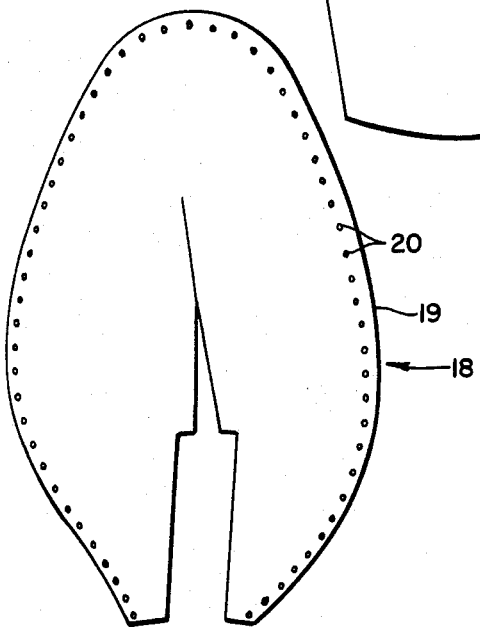
FIG. 5 is a top view of the under portion of the upper of the shoe prior to formation of the forepart shown in FIGS. 2 and 3.

As shown in FIG. 4, the top portion 12 of the upper of the shoe 10 is generally U-shaped to conform to the "feather line" of the last. In accordance with one embodiment of the present invention, apertures 16 are uniformly spaced along the outer perimeter 14 of the top portion 12 to permit attachment to the under portion 18 shown in FIG. 5 in a manner to be more specifically described hereinafter. The under portion 18 generally has an oval shape so as to also conform to the "feather-line" of the last and, in accordance with one embodiment, corresponding apertures 20 are uniformly spaced along the outer perimeter 19 thereof.

In accordance with the method of the present invention, the perimeter 14 of the top portion 12 is folded over the perimeter 19 of the under portion 18, and these overlapped portions 14 and 19 are then secured together by handsewing or by machine stitching to form a seam 22 therebetween. If the seam 22 is formed by handsewing, the apertures 16 and 20 are provided in the top portion 12 and under portion 18, respectively. In the case of machine stitching, however, the apertures 16 and 20 are not required.

In this manner, the forepart of the completed upper 11 shown in FIGS. 2 and 3 is formed with the seam 22. The forepart of the completed upper 11 acts as a cradle to the forepart of the foot in a manner identical to that of a moccasin and thus provides the comfort characteristics of a conventional moccasin.

Conventional slip lasting and finishing procedures are then employed to complete the shoe 10, with the sole 24 being attached to the under portion 18 using conventional methods. As shown in FIG. 1, the forepart seam 22 is located closely adjacent and substantially parallel to the edge of the sole 24 of the shoe 10 so as to provide the smooth, stylish appearance of a conventional pump.

From the foregoing description, it will be readily apparent that the construction and method of the present invention avoid the U-shaped seam characteristically located high on the upper portion of a traditional moccasin, while permitting the incorporation of the features and comfort of a moccasin construction in a full range of non-moccasin types of footwear.

What is claimed is:

1. An article of footwear comprising a flexible top portion shaped to surround the top front portion of a foot; a flexible under portion shaped to surround the bottom front portion of a foot; said top portion and said under portion being shaped to form a forepart of said article of footwear that is closed at its top, bottom and side portions; means joining the peripheries of said top portion and said under portion to form a seam therebetween and to form said forepart so that it will substantially enclose and contact the front portion of a foot in a manner like a moccasin; and a sole portion joined to said under portion; said seam being located closely adjacent and substantially parallel to said sole portion.

2. The article of claim 1 wherein said top portion and said under portion are formed of leather.

3. The article of claim 1 wherein said means is thread.

4. The article of claim 1 wherein the perimeter of said top portion extends over the perimeter of said under portion in said seam.

5. The article of claim 1 wherein the front peripheral section of said top portion has apertures therethrough, the periphery of said under portion has apertures therethrough, and said joining means extends through said apertures of said top portion of said under portion.

6. The article of claim 5 wherein said apertures in said top portion and said under portion are substantially uniformly spaced therein.

7. The article of claim 1 wherein said top portion is substantially U-shaped, and said under portion has a generally oval shape.

8. A method of forming an article of footwear, comprising the steps of:

forming a flexible top portion shaped to surround the top front portion of a foot;

forming a flexible under portion shaped to surround the bottom front portion of a foot;

joining the peripheries of said top portion and said under portion to form a seam therebetween and to form a forepart of said article of footwear that is closed at its top, bottom and side portions so that it will substantially enclose and contact the front portion of a foot in a manner like a moccasin; and securing a sole portion to said under portion such that said seam is positioned closely adjacent and substantially parallel to said sole portion.

9. The method of claim 8 wherein apertures are formed in the front peripheral section of said top portion, apertures are formed in the periphery of said under portion, and thread is passed through said apertures in said top portion and said under portion to form said seam therebetween.

10. The method of claim 8 wherein said thread is handsewn through said apertures.

11. The method of claim 8 wherein said front peripheral section of said top portion is positioned over said perimeter of said under portion prior to the joining thereof.

12. The method of claim 8 wherein said forepart is shaped and lasted after the formation thereof.

* * * * *

UNITED STATES PATENT AND TRADEMARK OFFICE

CERTIFICATE OF CORRECTION

PATENT NO. : 4,642,915

DATED : February 17, 1987

INVENTOR(S) : Wilhelm Pfander

It is certified that error appears in the above-identified patent and that said Letters Patent is hereby corrected as shown below:

In the Specification, Column 1, line 62, delete "2" and replace with --1--;

line 64, delete --upper--.

Claim 5, at Column 3, line 8, after "top portion" delete "of" and insert --and--.

Signed and Sealed this

First Day of September, 1987

*Attest:*

*Attesting Officer*

DONALD J. QUIGG

*Commissioner of Patents and Trademarks*